US011116688B2

(12) United States Patent
Hittel

(10) Patent No.: US 11,116,688 B2
(45) Date of Patent: Sep. 14, 2021

(54) APPARATUS FOR IMPROVING EXERCISE EQUIPMENT AND A METHOD OF USING THE SAME

(71) Applicant: Christopher Mat Hittel, Bradenton, FL (US)

(72) Inventor: Christopher Mat Hittel, Bradenton, FL (US)

(73) Assignee: M4 W6 IP Holdings LLC, Bradenton, FL (US)

( * ) Notice: Subject to any disclaimer, the term of this patent is extended or adjusted under 35 U.S.C. 154(b) by 0 days.

(21) Appl. No.: 16/804,240

(22) Filed: Feb. 28, 2020

(65) Prior Publication Data

US 2020/0276073 A1 Sep. 3, 2020

Related U.S. Application Data

(60) Provisional application No. 62/812,031, filed on Feb. 28, 2019.

(51) Int. Cl.

| | |
|---|---|
| ***A61H 3/00*** | (2006.01) |
| ***A63B 23/035*** | (2006.01) |
| ***A63B 69/00*** | (2006.01) |
| ***A63B 22/02*** | (2006.01) |

(52) U.S. Cl.

CPC ..... *A61H 3/008* (2013.01); *A63B 23/03575* (2013.01); *A63B 69/0064* (2013.01); *A63B 22/02* (2013.01)

(58) Field of Classification Search

CPC ..... A61H 3/008; A63B 23/03575; A63B 69/0064; A63B 22/02; A63B 21/169; A63B 21/068; A63B 23/1218; A63B 7/00; A63B 7/02; A63B 21/00181

See application file for complete search history.

(56) References Cited

U.S. PATENT DOCUMENTS

| | | | | | |
|---|---|---|---|---|---|
| 4,519,605 | A * | 5/1985 | Leland | A63B 21/023 | 482/130 |
| 4,625,962 | A * | 12/1986 | Street | A63B 21/015 | 482/116 |
| 4,655,447 | A | 4/1987 | Dubrinsky et al. | | |
| 4,861,021 | A | 8/1989 | Edwards et al. | | |
| 5,171,196 | A * | 12/1992 | Lynch | A63B 21/154 | 482/54 |
| 5,450,923 | A * | 9/1995 | Ker | A62B 5/00 | 182/239 |

(Continued)

*Primary Examiner* — Garrett K Atkinson

(74) *Attorney, Agent, or Firm* — Dunlap Bennett & Ludwig, PLLC

(57) ABSTRACT

An upper-body apparatus for enhancing the workout of a lower-body exercise equipment and a method of using the same is provided. The upper-body apparatus is mounted above the lower-body exercise equipment for adding pull-up and pull-out functionality thereto. The upper-body apparatus has two tension elements depending from and spaced apart along a mounting surface above the lower-body exercise equipment. Each tension elements terminates in a swivel-connected handle just above the head of the user. An elastic cord interconnects the cuffs of the handles. The handles and elastic cords facilitate the pull-up and pull-out functionality for the user of the lower-body exercise equipment.

5 Claims, 4 Drawing Sheets

(56) References Cited

U.S. PATENT DOCUMENTS 5,626,540 A * 5/1997 Hall ..... A61H 1/0229 482/69
5,662,560 A * 9/1997 Svendsen ..... A61H 3/04 482/54
5,951,449 A * 9/1999 Oppriecht ..... A63B 21/0087 482/113
6,036,622 A * 3/2000 Gordon ..... A63B 21/154 482/51
6,146,315 A 11/2000 Schonenberger
6,273,844 B1 8/2001 Kelsey et al.
6,450,923 B1 9/2002 Vatti
6,726,606 B2 * 4/2004 Jacobsen ..... A63B 21/0552 482/121
7,255,666 B2 * 8/2007 Cardenas ..... A61H 1/0229 482/143
7,878,950 B1 2/2011 Bastian
7,918,767 B1 4/2011 Wilson
8,012,071 B2 * 9/2011 Grisdale ..... A63B 21/0552 482/122
8,152,704 B2 * 4/2012 Brice ..... A63B 21/00 482/129
8,517,899 B2 * 8/2013 Zhou ..... A63B 69/182 482/71
8,876,679 B2 * 11/2014 DeMarco ..... A63B 1/00 482/143
9,132,356 B2 * 9/2015 Giordano ..... A63B 7/00
9,289,643 B2 * 3/2016 Demarco ..... A63B 21/00181
9,486,663 B2 * 11/2016 DeMarco ..... A63B 7/00
9,517,374 B2 * 12/2016 Alexandrov ..... A63B 7/02
9,713,738 B2 * 7/2017 Schrag ..... A63B 21/169
9,839,805 B2 * 12/2017 Demarco ..... A63B 21/0557
D816,785 S * 5/2018 Smith, Jr. ..... D21/694
10,188,890 B2 * 1/2019 Olson ..... A63B 21/4035
10,441,840 B2 * 10/2019 Dalebout ..... A63B 21/4043
10,561,890 B2 * 2/2020 Michaels ..... A63B 22/0664
10,668,320 B2 * 6/2020 Watterson ..... A63B 23/1209
10,953,268 B1 * 3/2021 Dalebout ..... A63B 23/03533
2003/0216220 A1 * 11/2003 Rota ..... A63B 21/1627 482/27
2005/0255971 A1 11/2005 Solomon
2007/0287601 A1 * 12/2007 Burck ..... A63B 22/02 482/54
2008/0132391 A1 * 6/2008 Edeker ..... A63B 21/155 482/121
2008/0293545 A1 * 11/2008 Planke ..... A63B 21/00196 482/7
2009/0075789 A1 * 3/2009 Hetrick ..... A63B 23/1209 482/91
2009/0215593 A1 * 8/2009 Ligrano ..... A63B 21/00185 482/124
2010/0144496 A1 * 6/2010 Schmidt ..... A63B 21/4035 482/70
2012/0202662 A1 * 8/2012 DeMarco ..... A63B 23/1236 482/143
2012/0295776 A1 * 11/2012 Chen ..... A63B 21/0557 482/121
2013/0225371 A1 8/2013 Harrer et al.
2016/0016033 A1 * 1/2016 Schrag ..... A63B 21/4019 482/112
2017/0113090 A1 4/2017 Wilson

* cited by examiner

APPARATUS FOR IMPROVING EXERCISE EQUIPMENT AND A METHOD OF USING THE SAME

CROSS-REFERENCE TO RELATED APPLICATION

This application claims the benefit of priority of U.S. provisional application No. 62/812,031, filed 28 Feb. 2019, the contents of which are herein incorporated by reference.

BACKGROUND OF THE INVENTION

The present invention relates to exercise equipment and, more particularly, to an apparatus for improving exercise equipment, wherein the apparatus is mounted above the exercise equipment for adding a pull up and pull out functional component, and a method of using the same.

Boredom, poor posture, and other negative consequences can result from repeated exercise routines, especially from exercise regimes that focus on just the lower body, such as those that use treadmills and stationary bikes. Specifically, treadmill and stationary bike users tend to slump over during their exercise routine, leading to poor posture. Moreover, being slumped over physiologically induces or tends to induce boredom in the athlete. Furthermore, doing the same thing over and over already causes users of treadmills and stationary bikes to lose interest in maintaining a regular exercise routine.

Additionally, treadmills produce a high degree of impact on the joints, especially the joints of the spine, hips, knees, ankles and feet. Causing inflammation and fatigue of the joints and supporting structure (e.g., muscles, tendons, etc.) from the repeated pounding treadmills cause the user's spine, hips, knees, ankles and feet.

As can be seen, there is a need for an apparatus for improving exercise equipment, wherein the apparatus is mounted above the exercise equipment for adding a pull up and pull out functional component.

By enabling the additional pulling upward and pulling outward exercise functionality, the present invention facilitates a user developing additional muscles while they use their tried-and-true exercise equipment, as well as reduce impact, inflammation and/or fatigue on the joints of their spine, hips, knees, ankles and feet. Also, the present invention empowers a better posture.

Furthermore, it goes without saying, by exercising the upper and lower body simultaneously, one is exerting a compounded amount of total energy; in essence, converting the stationary lower-body exercise equipment into a cross training machine by incorporating the present invention.

SUMMARY OF THE INVENTION

In one aspect of the present invention, an upper-body apparatus for enhancing a stationary lower-body exercise equipment includes the following: two tension elements dependable from a mounting surface; each tension element extending from a mounting end to a handle end; a swivel connector operatively associated with each handle end; a handle depending from each swivel connector; and an elastic cord interconnecting said swivel connectors.

In another aspect of the present invention, the upper-body apparatus for enhancing a stationary lower-body exercise equipment further includes a handle strap interconnecting the handle to each swivel connector, wherein the two tension elements are spaced apart along the mounting surface a mounting distance dimensioned and adapted to be approximately equal to a shoulder width of a human user, and wherein a cord length of the elastic cord is approximately half of the shoulder width. By approximate half, the inventor suggests between zero and six inches from exactly half.

In yet another aspect of the present invention, a method of adding a pull-out and pull-up functionality to a stationary lower-body exercise equipment includes providing the above-mentioned upper-body apparatus; and mounting the two tension elements so that the handles terminate at approximately four inches above a head of the human user accommodated by the stationary lower-body exercise equipment.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an upper-body apparatus for enhancing the workout of a lower-body exercise equipment, wherein the upper-body apparatus may be mounted above the lower-body exercise equipment for adding pull-up and pull-out functionality thereto. The upper-body apparatus has two tension elements depending from and spaced apart along a mounting surface above the lower-body exercise equipment. Each tension elements terminates in a swivel-connected handle, between which is an elastic cord. The handles and elastic cords facilitate the pull-up and pull-out functionality for the user of the lower-body exercise equipment.

Figure 1:
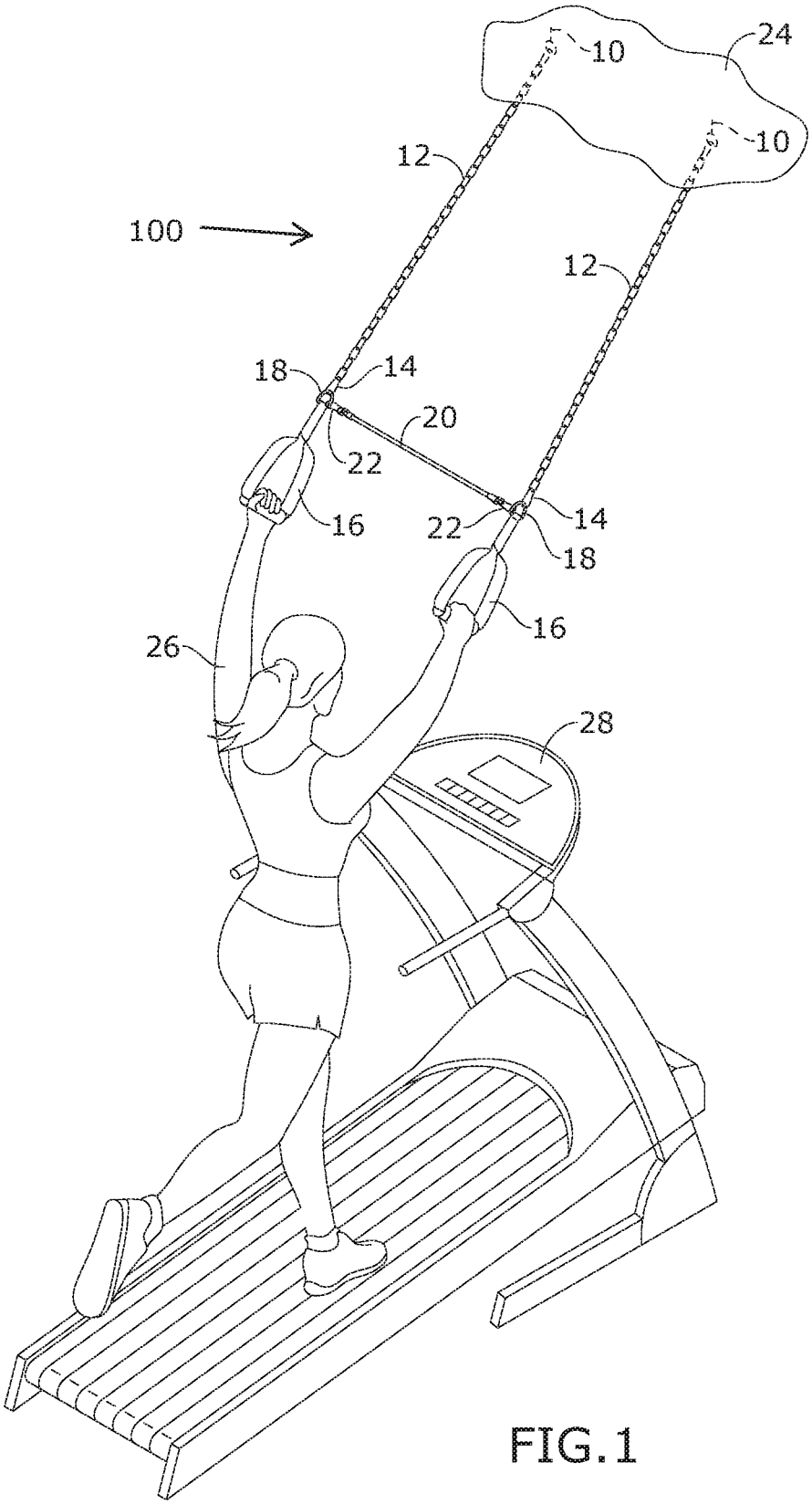
FIG. 1 is a top perspective view of an exemplary embodiment of the present invention, shown in use.
Figure 2:
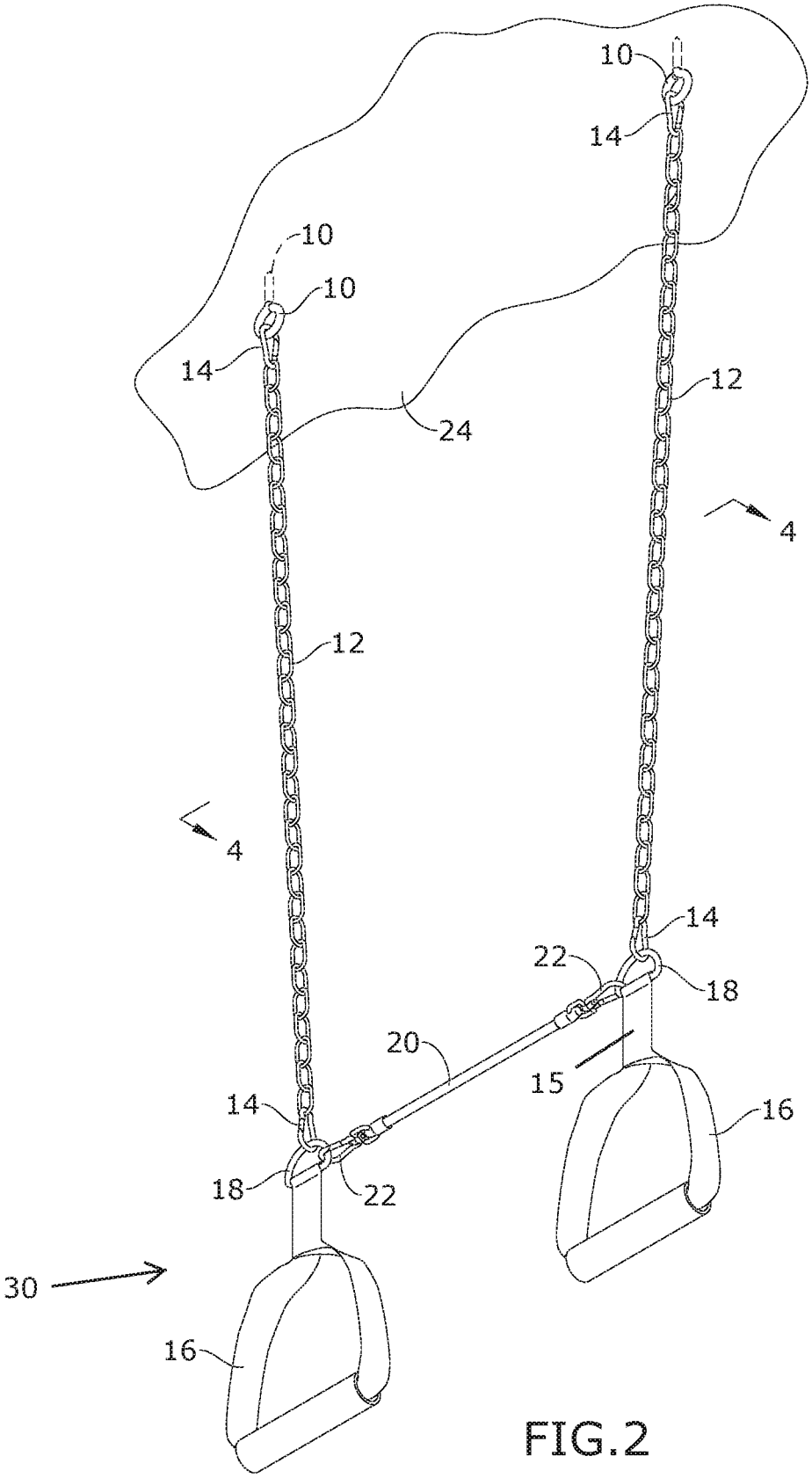
FIG. 2 is a bottom perspective view of an exemplary embodiment of the present invention.
Figure 3:
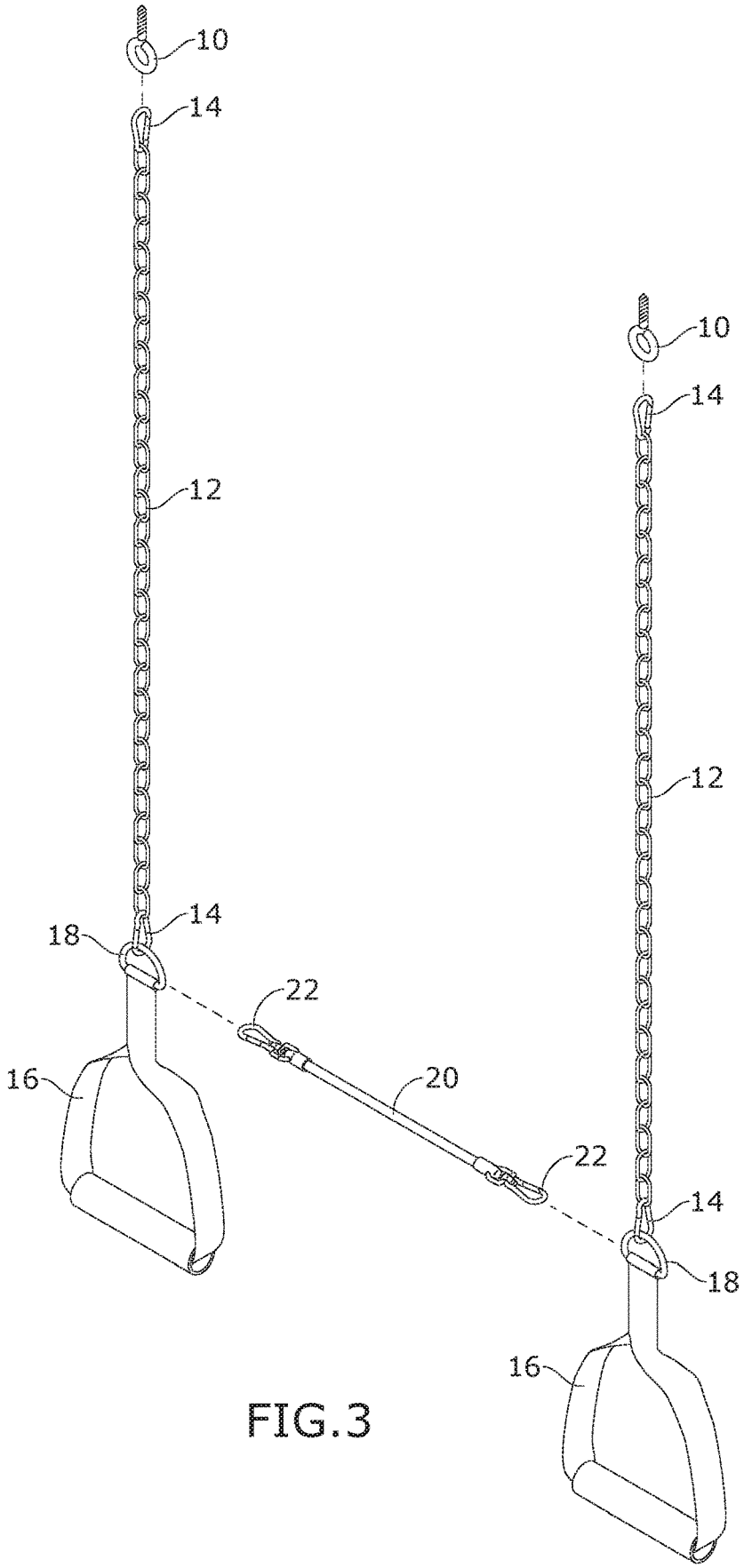
FIG. 3 is an exploded perspective view of an exemplary embodiment of the present invention.
Figure 4:
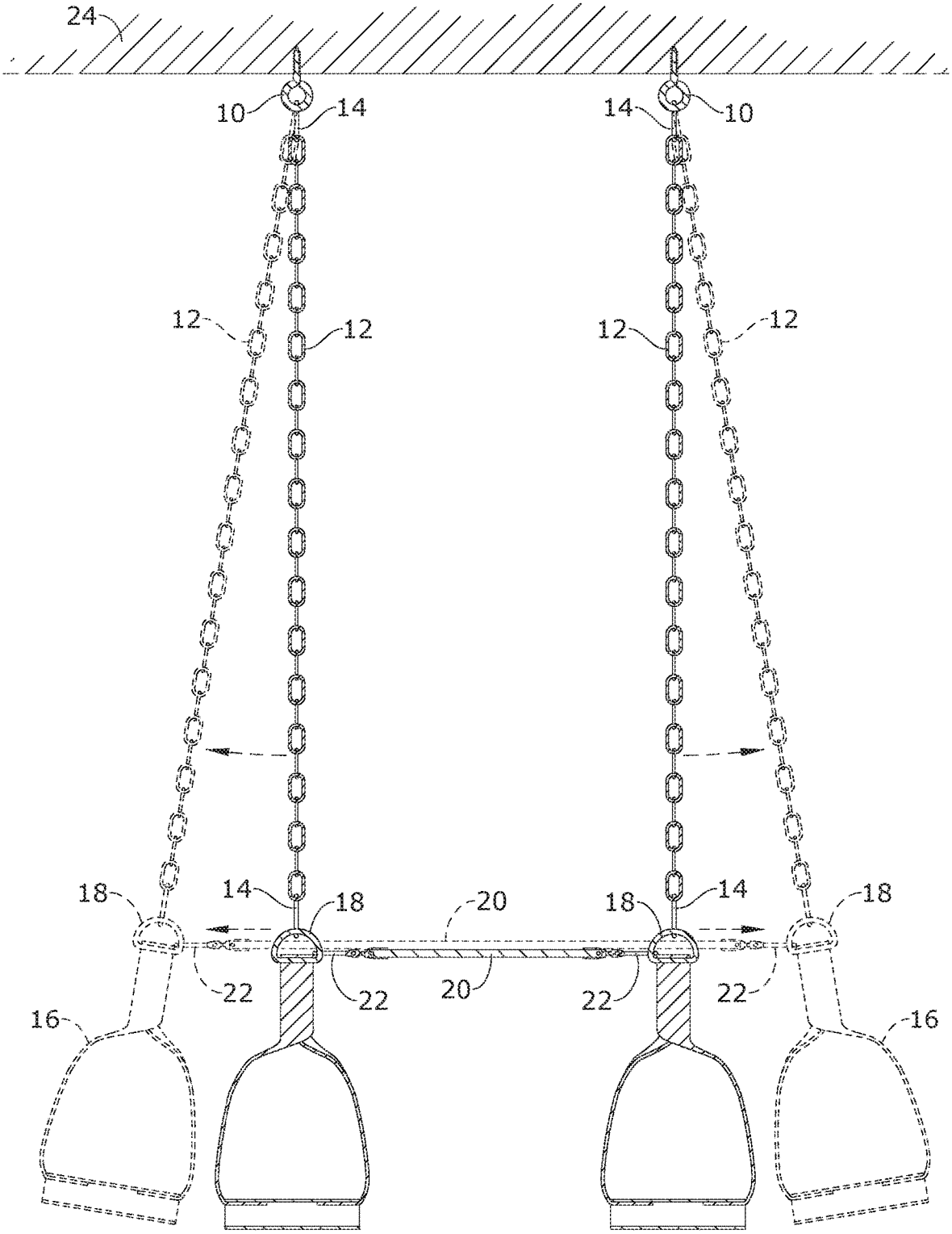
FIG. 4 is a section view of an exemplary embodiment of the present invention, taken along line 4-4 of FIG. 2, illustrating the stretching of an elastic cord 20 as the handles 16 are urged upward and outward.

Referring to FIGS. 1 through 4, the present invention may include an upper-body apparatus 100 for enhancing the workout of a lower-body exercise equipment 28, wherein the upper-body apparatus 100 may be mounted above the lower-body exercise equipment 28 for adding a pull-up and pull-out functionality to an exercise routine of a user 26 of the lower-body exercise equipment 28.

It should be understood by those skilled in the art that the use of directional terms such as upper, upward, lower, downward, outward and the like are used in relation to the illustrative embodiments as they are depicted in the figures, the upward direction (or upper) being toward the top of the corresponding figures, the downward direction being toward the bottom of the corresponding figures, and the outward direction being toward the sides of the corresponding figures.

The upper-body apparatus 100 may include two spaced apart tension elements 12 operatively associated with an elastic handle portion 30. The tension elements 12 may be ropes, chains, or other elongated tension elements that can accommodate the weight of a user 26 with little or no give. Each tension element 12 extends between a mounting end and an operable end operatively associated with the elastic handle portion 30.

Each mounting end provides an end connector 14 for engaging a mounting connector 10 for mounting the tension elements 12 to a mounting surface 24 (such as a ceiling, wall, floor/wall/ceiling attachment, structure mounted to the floor reaching above the head of the user, or the like) elevated above the exercise equipment 28. The mounting connector 10 may be, but are not limited to, an eye hook. The end connectors 14 may be openable/removable connectors, such as a carabiners or the like.

The elastic handle portion 30 may include a handle 16 depending from each tension element 12 and an elastic cord 20 operatively associating both said handles 16. The handle 16 may be connected to each tension element 12 by way of an end connector 14 and a swivel connector 18, which may be a D-ring or the like. A handle strap 15 may interconnect the swivel connector 18 and the handle 16. An elastic connector 22 may interconnect each end of the elastic cord 20 to the swivel connector 18.

A method of using the present invention may include the following. The upper-body apparatus 100 disclosed above may be provided. The two end connectors 14 of the mounting ends of the tension elements 12 may be removably attached to the mounting connectors 10 along the mounting surface 24. The two tension elements 12 may be approximately spaced apart above the outside of the shoulders of the user 26 when properly accommodated by the exercise equipment 28 (exact location may be adjusted to personal preference). By "approximately", the inventor suggests from zero to six inches on either side of the shoulder. Each tension element should terminate about one to twelve inches above the head of the user 26. The elastic cord 20 may be of a cord length equal to approximately half the distance that the two mounted ends are spaced apart along the mounting surface 24.

Once the upper-body apparatus 100 is mounted above the head of the user 26 accommodated by the exercise equipment 28, while exercising on the exercise equipment 28, the user 26 grabs the handles 16 and themselves pulls upward and pulls outward through engaging the tension elements 12. The mounted tension elements 12 may be used by the user 26 to pull against so as to lift ("pulling up") their body upward by way of the handles 16. Through the pivotable swivel connectors 18 the user 26 grabbing the handles 16 and can turn or rotate their hands. The elastic cord 20 provides resistance when the user 26 urges the handles 16 away from each other ("pulling out"). Note, just as the user 26 would pull out, the handles 16 would point outwardly. By using upper body muscle to transfer weight from the lower body, by pulling up and/or out, the upper body is lifted and expanded as compared to the action of holding on to the rails of, say a treadmill which contracts and pinches the upper body. Thus, by pulling up and out the user improves their posture and build upper body strength.

In an embodiment where the exercise equipment 28 is a treadmill, as the user 26 walks or jogs thereon, they allow their feet to stretch out and the lower body to drop down slightly as their upper body is pulled up from the muscles in their arms, shoulders, chest and back. The muscles in the stomach, hips legs, knees, ankles and feet are used differently and begin to train themselves for better posture and less impact. After using the upper-body apparatus 100, the user 26 learns a new gate for walking with a better posture and less impact, even when they are not using the present invention.

Additionally, the present invention may be used as a tool for physical therapy; for instance, after hip replacement a user 28 may walk with less pressure on their new hip. For users of walkers, they can exercise by pulling up with this device instead of pushing down on the walker. Users 26 with lower back conditions can exercise with less impact and less pressure on the spine.

It should be understood, of course, that the foregoing relates to exemplary embodiments of the invention and that modifications may be made without departing from the spirit and scope of the invention as set forth in the following claims.

What is claimed is:

1. An upper-body apparatus for enhancing a stationary lower-body exercise equipment, comprising:

two tension elements dependable from a mounting surface;

each tension element extending from a mounting end to a handle end;

a swivel connector operatively associated with each handle end;

a handle depending from each swivel connector by way of a handle strap; and an elastic cord interconnecting said swivel connectors, wherein the handle strap interconnects each handle to each swivel connector, respectively, and wherein each handle strap has a strap length less than a cord length of the elastic cord.

2. The upper-body apparatus of claim 1, wherein each swivel connector is a D-ring.

3. The upper-body apparatus of claim 1, wherein the two tension elements are spaced apart along the mounting surface a mounting distance dimensioned and adapted to be approximately equal to a shoulder width of a human user.

4. The upper-body apparatus of claim 3, wherein a cord length of the elastic cord is approximately half of the shoulder width.

5. A method of adding a pull-out and pull-up functionality to a stationary lower-body exercise equipment, comprising:

providing the upper-body apparatus of claim 3; and mounting the two tension elements so that the handles terminate at approximately four inches above a head of the human user accommodated by the stationary lower-body exercise equipment.

* * * * *